US005167330A

United States Patent [19]

Kveene

[11] Patent Number: 5,167,330

[45] Date of Patent: Dec. 1, 1992

[54] ROTATING STORAGE RACK

[76] Inventor: John L. Kveene, 277 Greenway Cir. E, Broomfield, Colo. 80020

[21] Appl. No.: 818,771

[22] Filed: Jan. 13, 1992

[51] Int. Cl.[5] ..... A47F 1/00

[52] U.S. Cl. ..... 211/164; 211/131

[58] Field of Search ..... 211/164, 131, 175, 126; 220/335, 8

[56] References Cited

U.S. PATENT DOCUMENTS 1,281,105 10/1918 Unger .
1,552,290 9/1925 Fowler ..... 211/64 X
1,867,145 7/1932 Godfrey .
3,038,773 6/1962 Vasbinder .
3,784,024 1/1974 Kristy ..... 211/164 X
4,303,283 12/1981 Mueller ..... 211/164 X

*Primary Examiner*—Alvin C. Chin-Shue
*Attorney, Agent, or Firm*—Terry M. Gernstein

[57] ABSTRACT

A storage rack includes a U-shaped bracket that can be fixed to another element, such as a shelf, and an axle rotatably mounted on the bracket. Each of two support wheels includes a plurality of support holes and each is fixed to the axle for rotation therewith. Each of a plurality container units is connected to the wheels by L-shaped support elements. The container units can include closing elements, and rotate about the axle. An indexing mechanism controls the rotation of the wheels.

16 Claims, 5 Drawing Sheets

FIG. 1
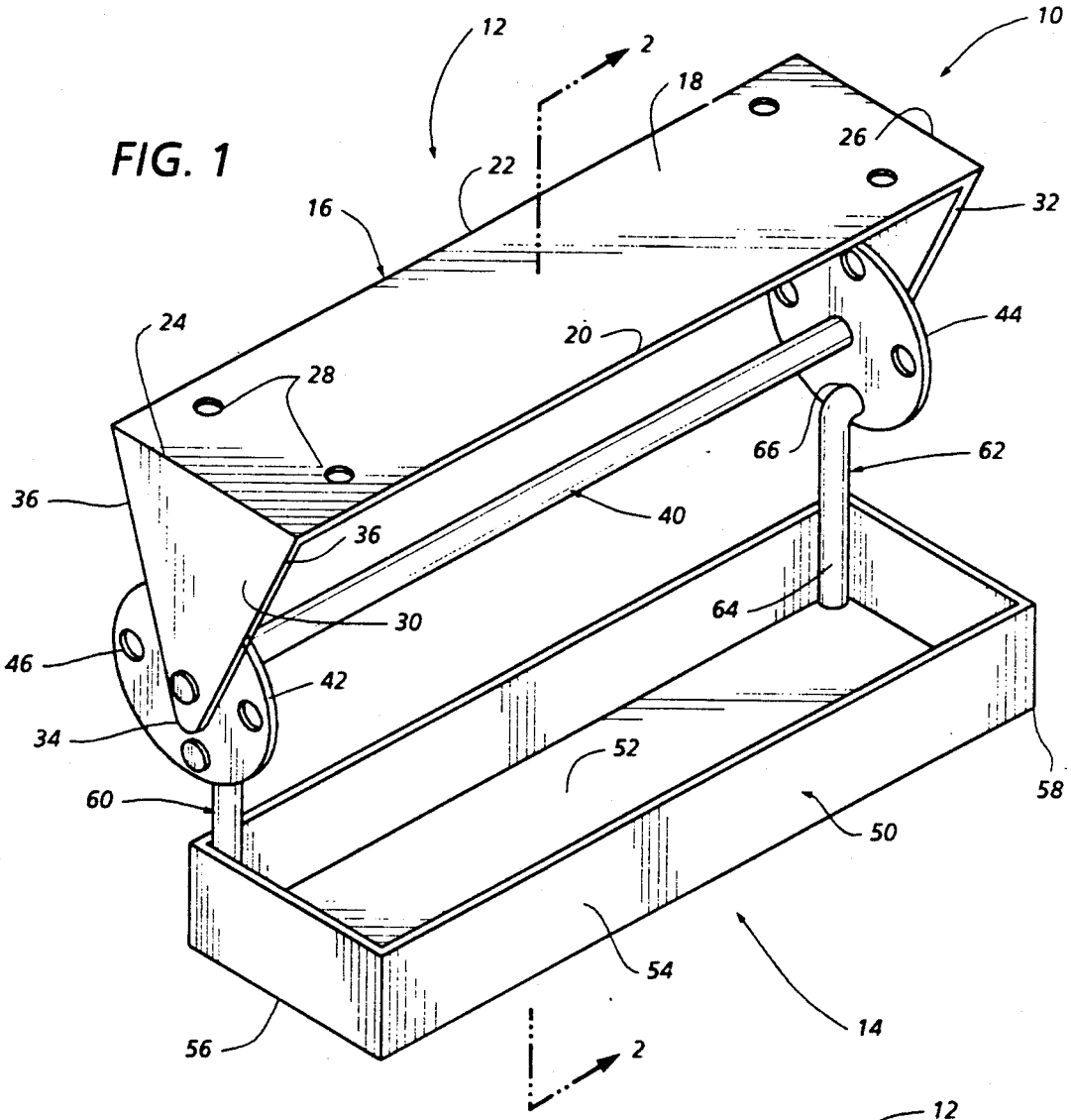
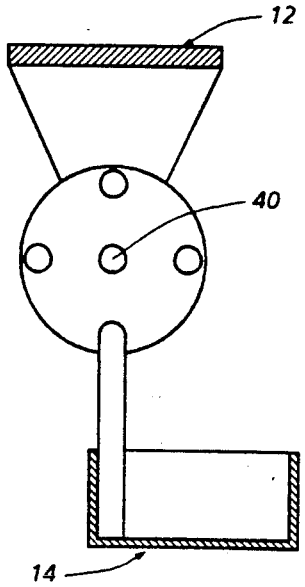
FIG. 2

ROTATING STORAGE RACK

TECHNICAL FIELD OF THE INVENTION

The present invention relates to the general art of containers, and to the particular field of racks having a plurality of containers.

BACKGROUND OF THE INVENTION

Many kitchens, workshops and the like include a multiplicity of various utensils and tools. These workshops and kitchens also include paper goods, as well as wrapping and work elements.

As the ability of the worker using the kitchen and/or workshop increases, the number of tools and utensils, as well as the number of peripheral equipment stored in the workshop or kitchen increases. At some point, the storage space available to the worker becomes extremely limited. The lack of storage space may dissuade the worker from purchasing needed equipment.

Adding shelves, drawers and cabinets to the work area will help, but this solution, also, is limited. This solution also may be expensive and otherwise undesirable. Accordingly, the art has included items such as spice racks, and various display-type racks that are intended to store items in a manner that makes such items readily available to a worker.

While somewhat successful, such racks still have short-comings that will preclude their use in some situations. For example, these racks may not be sturdy enough to store bulky items. Still further, these racks may not be large enough to store large items, such as paper products or the like.

Yet another drawback to these racks is their inability to be readily adapted and modified to fit changing needs of the worker. That is, if a rack is purchased for storing small bottles, such as a spice rack, that rack is not easily adapted to store large paper products, such as waxed paper containers. Still further, these items may take up valuable room on a shelf without providing a concomitant increase in storage ability.

Still another drawback to the known storage racks is the problem of controlling the operation thereof. For example, if a display rack is rotated, it may tend to move to a new position once it is released. If the worker wishes to use the rack again, that worker may be required to rotate the rack back to the desired orientation.

Therefore, there is a need for a storage rack that is capable of efficiently storing a large variety of items, including items of various sizes, and which is easily mounted and used, yet which is easily controlled.

OBJECTS OF THE INVENTION

It is a main object of the present invention to provide a storage rack that is capable of efficiently storing a large variety of items.

It is another object of the present invention to provide a storage rack that is capable of efficiently storing a large variety of items, including items of various sizes.

It is another object of the present invention to provide a storage rack that is capable of efficiently storing a large variety of items, and is easily adapted to store different size items.

It is another object of the present invention to provide a storage rack that is capable of efficiently storing a large variety of items, including items of various sizes, and which is easily mounted and used.

It is another object of the present invention to provide a storage rack that is capable of efficiently storing a large variety of items, including items of various sizes yet which is easily controlled.

SUMMARY OF THE INVENTION

These, and other, objects are achieved by a storage rack having a plurality of container units mounted for rotatable movement on a support unit. The rack further includes an indexing means for controlling movement of the container units. The support unit includes a bracket that can be mounted beneath a shelf or beneath a cabinet, and which supports an axle to which wheel elements are attached. The container units are connected to the wheel units, and rotation of the axle moves the container units. The wheel elements are rotated until the desired container unit is in the desired orientation with respect to the user.

The indexing means permits the rack to operate under the influence of gravity but will ensure that the rack will stop each time a container unit is in a dispensing or receiving orientation. In this manner, the rack can be set to adjust itself into a particular orientation, yet will be easily moved to any other orientation.

The container units also have means for modifying the shape and size thereof so large or small items can be easily accommodated in each container unit.

BRIEF DESCRIPTION OF THE DRAWING FIGURES

FIG. 1 is a perspective view of a storage rack embodying the present invention, with only one container unit being shown for purposes of illustration.

FIG. 2 is an end elevational view thereof taken along line 213 2 of FIG. 1.

DETAILED DESCRIPTION OF THE PREFERRED EMBODIMENT OF THE INVENTION

Figure 4:
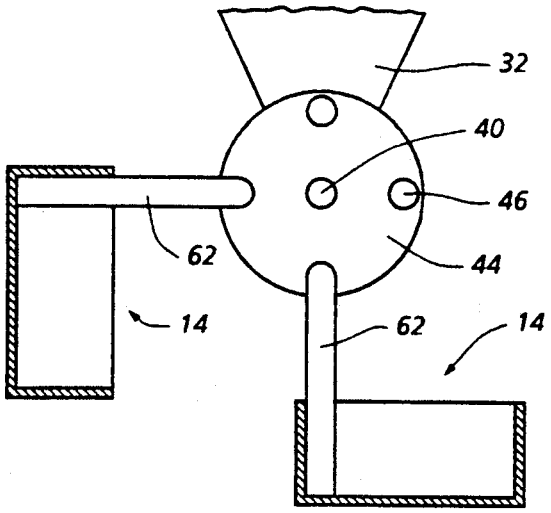
FIG. 4 is an end elevational view of a support wheel having two container units attached thereto.
Figure 3:
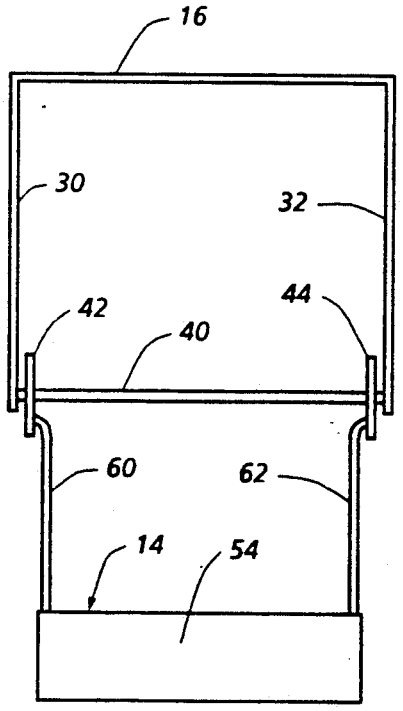
FIG. 3 is a front elevational view thereof, the rear being a mirror image of the front shown in FIG. 3.

Shown in FIGS. 1–4 is a storage rack 10 that includes a support unit 12 supporting a plurality of container units 14. The support unit 12 can be fixed to a shelf, a cabinet, or the like, and will support the container units in a manner that makes any items stored in the container units readily available for use.

The support unit includes a U-shaped bracket 16 having a rectangular base 18. The base 18 includes a front side edge 20, a rear side edge 22, and two end edges 24 and 26, with four mounting fastener-receiving holes 28 defined therethrough near the corners formed by the intersection of the side and end edges. Fasteners, such as self-tapping wood screws (not shown) are received through the holes 28 to secure the support unit to an element such as a shelf, or the like. The support unit further includes two triangular ears 30 and 32 having a base thereof formed by the end edge associated therewith, and an apex, such as apex 34 of ear 30, spaced from the base. The triangular ears are in the form of isosceles triangles with equal legs, such as legs 36 of ear 30. When the base is fixed to the undersurface of a support element, the ears depend downwardly from that support element in the manner indicated in FIG. 1. However, the base can be fixed to any support surface to extend upwardly or horizontally, or at any other angle desired.

An axle 40 has its ends rotatably fixed to the ears and extends parallel to the base 18. The axle can be formed of wood or any other suitable material. Two support wheels 42 and 44 are fixed to the axle for rotation therewith. The wheels 42 and 44 are identical, and each wheel is positioned closely adjacent to a support ear. The wheels are located within the perimeter defined by the ears 30 and 32 for a purpose that will be understood from the ensuing discussion.

Each wheel includes four identical support holes, such as hole 46 in wheel 42. The holes are all spaced from each other about the periphery of the wheel and are all located at identical radial distances from the center of the wheel. This spacing and location of the holes permits the rack to be balanced. The wheels rotate about the centers thereof, with the axle being located at the center of each wheel.

The container unit 14 includes a rectangular container 50 having a base 52 and a wall 54 extending upward from the base 52. The base and wall are sized to be slightly smaller than the periphery of the base 18. That is, the length dimension of the base 18 as measured between the end edges 24 and 26 exceeds the length dimension of the base 52 as measured between the ends 56 and 58 thereof. This relative sizing permits the containers to pass between the ears 30 and 32 as the wheels are rotated.

Two L-shaped support elements 60 and 62 attach the container to the wheels. The support elements 60 and 62 are identical, and each includes a long leg, such as leg 64, connected to the container and a short leg, such as leg 66, that is received in one of the support holes 46.

As shown in FIG. 1, the container is pendently supported from the wheels by the support elements, and can move in carousel fashion about the axle. Any item stored in the container will be oriented for use when the container is in the position shown in FIG. 1. The containers can be moved by turning the wheels or by applying force the containers. Two container units are shown in FIG. 4, and as many as four container units can be used in conjunction with the rack. If more support holes are used, more container units can be used.

Figure 5:
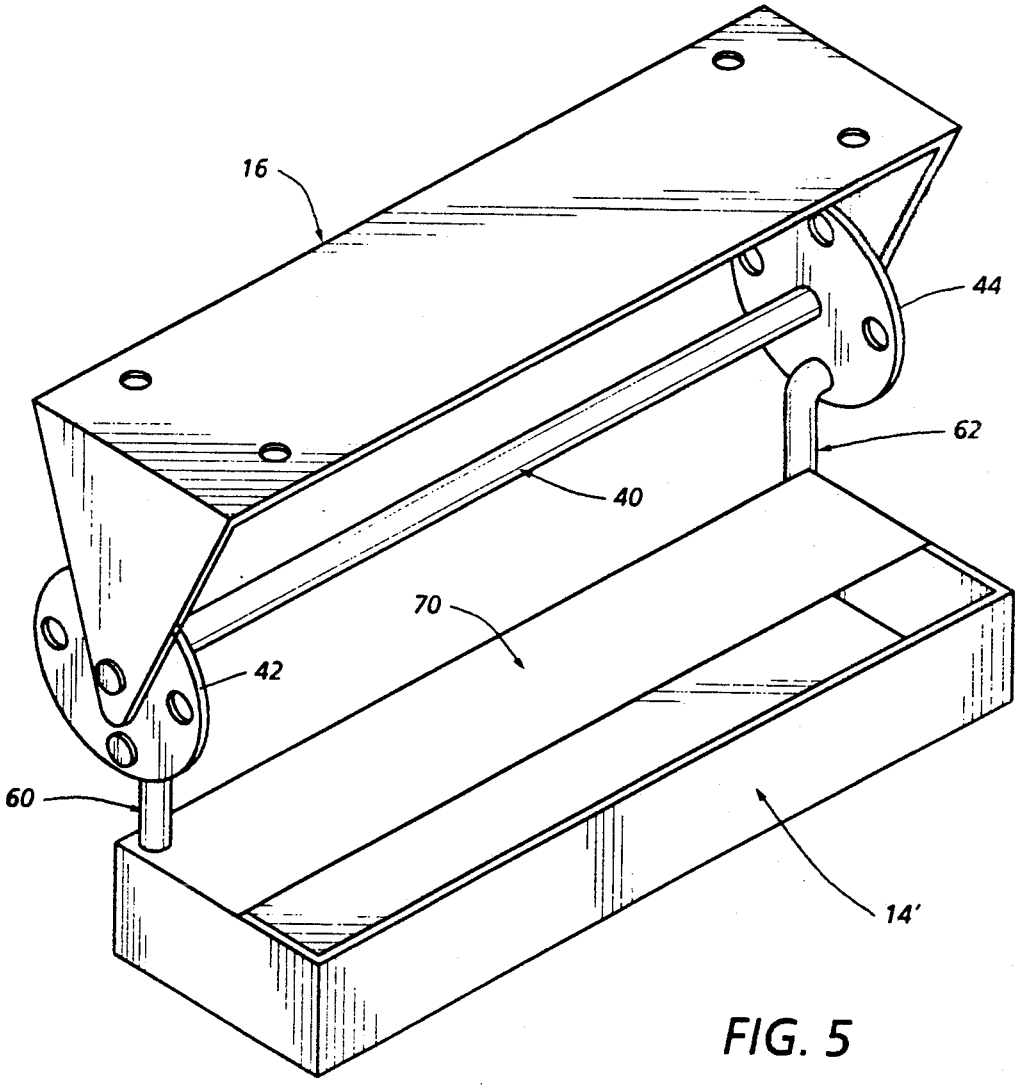
FIG. 5 is a perspective view of an alternative form of the storage rack in which a container unit is partially covered by a top plate.

An alternative form of the container is shown in FIG. 5. The container 14' includes a closing means, such as a top plate 70 mounted on the wall 54. The top plate permits the container to hold loose items without spilling these items out as the container moves around the central axis of the axle as above discussed.

Figure 6:
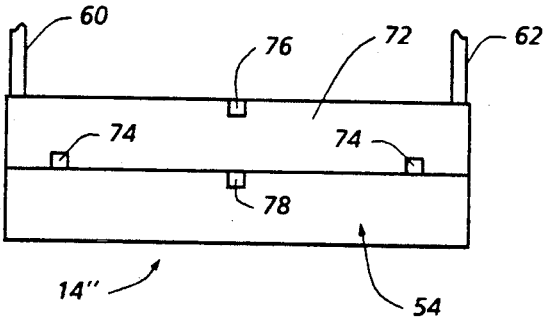
FIG. 6 is a front elevational view of another alternative of the container unit in which a container unit is covered by a hinged cover.
Figure 7:
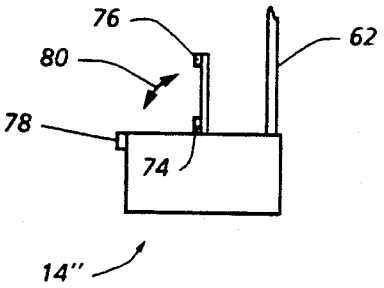
FIG. 7 is an end elevational view of the container unit shown in FIG. 6.

Yet a further form of the container is shown by container 14'' in FIGS. 6 and 7. The container 14'' includes the top plate 70 having a second plate 72 attached thereto by hinges 74. The second plate further includes a lock 76 that mates with a lock 78 on the wall 54 to lock the container in a closed configuration. The second plate moves between a closed condition with the locks 76 and 78 engaged, to an open condition shown in FIG. 7 as indicated by double-headed arrow 80. The second plate permits the container to be completely closed whereby items in the container can be prevented from falling out as the container moves about the axle longitudinal centerline.

Figure 8:
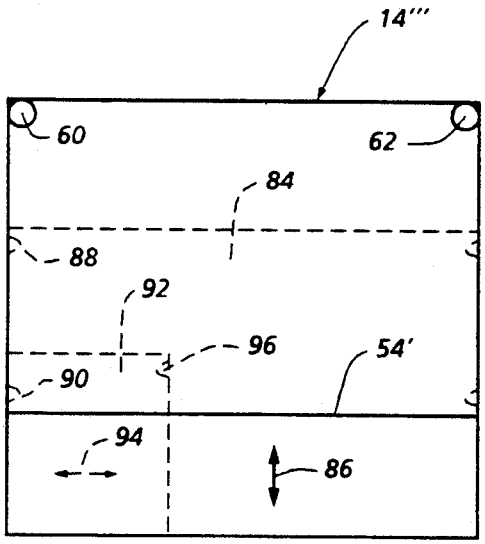
FIG. 8 is a top plan view of another form of the container unit in which the container includes means for varying the size thereof.
Figure 9:
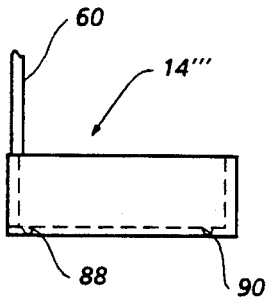
FIG. 9 is an end elevational view of the container unit shown in FIG. 8.
Figure 10:
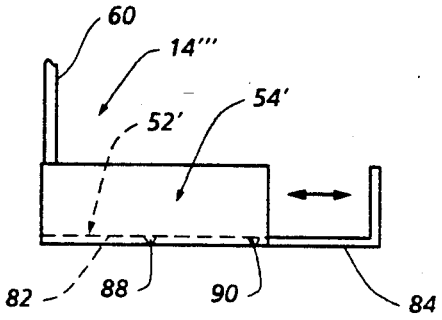
FIG. 10 is an end elevational view of the container unit shown in FIG. 8, with the container unit partially extended.

Yet a further form of the container is shown in FIGS. 8, 9 and 10 as container 14'''. The container 14''' has means for permitting expansion of the container, and includes a double-walled bottom 52' having a chamber 82 defined therein. A first plate 84 is slidably received in the chamber 82 to move into and out of the chamber as indicated by double-headed arrow 86. A front wall 88 is mounted on the chamber and forms one portion of the wall 54' of the container 14''' when the plate is fully inserted into the chamber 82. Stop elements 88 and 90 fixed to the plate 84 and to the double-walled bottom 52' respectively are oriented with respect to each other to engage when the plate 84 is fully extended from being pulled out of the chamber and separated from the rest of the container. Pulling the plate out of the chamber expands the container in the event that large objects are to be stored therein.

The container can be further expanded by wings 92 located in chambers in the plate 84. The wings move between a stored condition inside the plate and an deployed position extending out of the plate as indicated by double-headed arrow 94. The wings have a stop element 96 thereon that engages the stop element 90 to prevent the wing from being separated from the plate. The stop elements preferably include pimple-like projects on the elements, but can be other forms as will occur to those skilled in the art based on the teaching of this disclosure.

Figure 12:
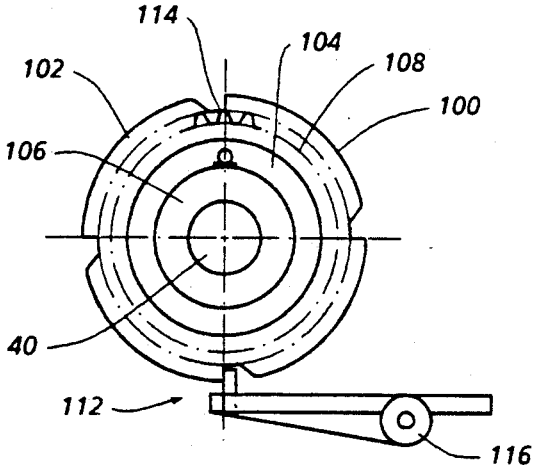
FIG. 12 is a front elevational view of a preferred form of indexing means.
Figure 13:
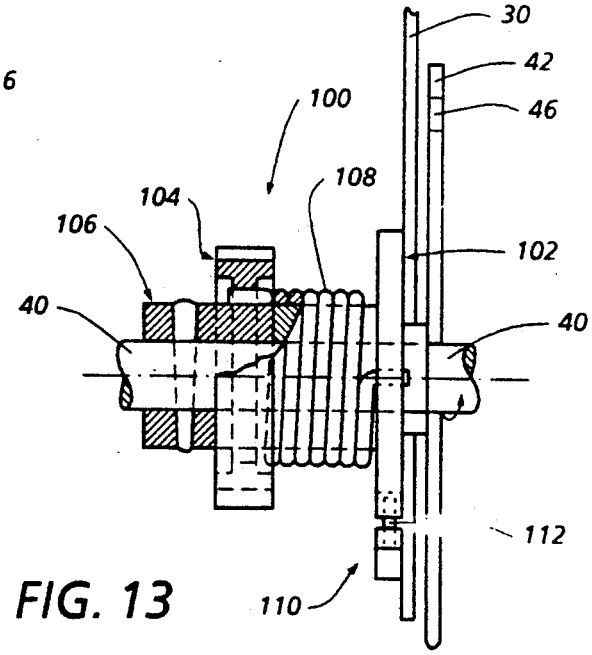
FIG. 13 is an end elevational view of the indexing means shown in FIG. 12.
Figure 11:
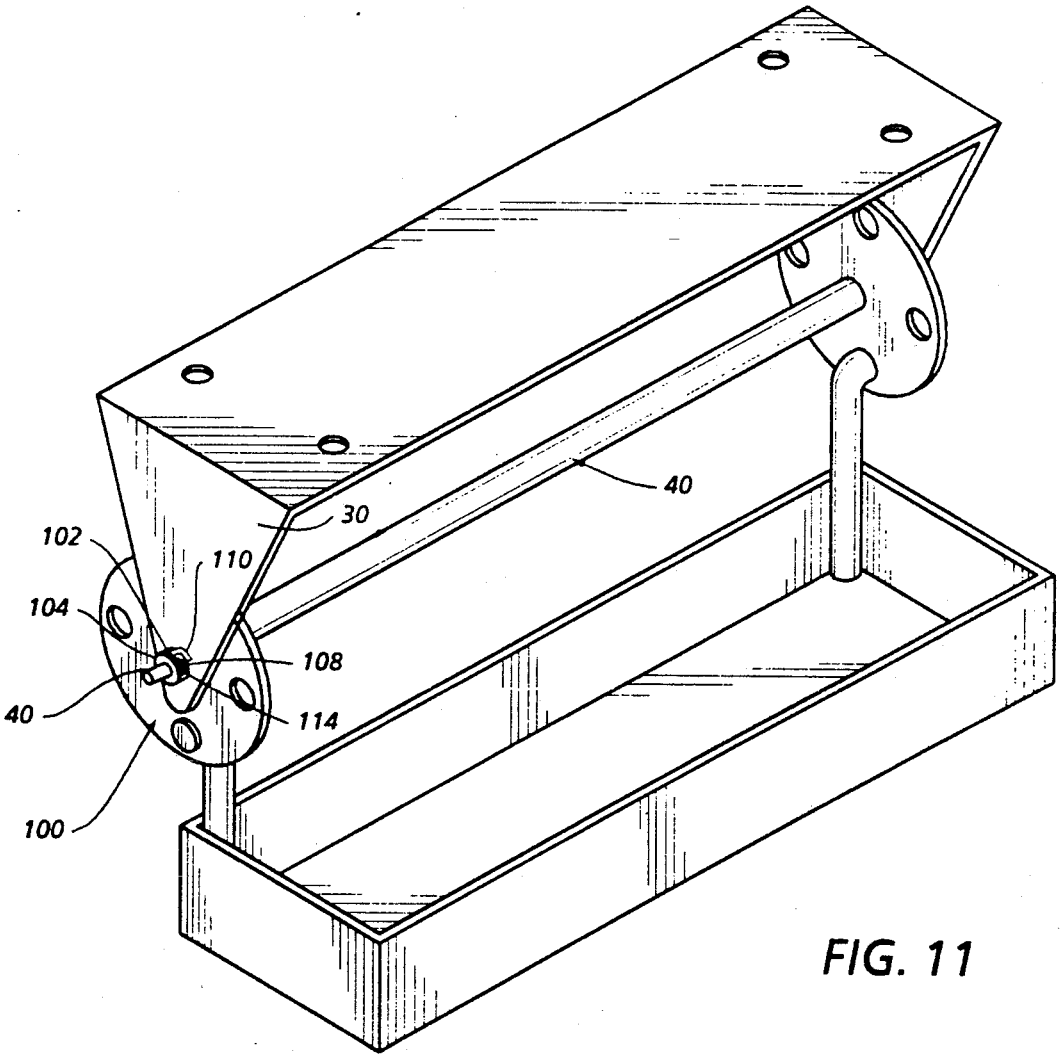
FIG. 11 is a perspective view of yet another alternative form of the storage rack in which an indexing means is included thereon.

In many instances, the container with the heaviest objects stored therein will automatically move to the lowest position, shown in FIG. 1. However, this may not be the most desirable position. Therefore, the rack 10 includes an indexing means for controlling movement of the containers. The indexing means is best shown in FIGS. 11, 12 and 13, and serves to maintain a desired orientation of containers. The indexing means 100 includes a spring clutch designed to automatically engage at the end of prescribed amounts of rotation of the axle. In the form shown, the clutch engages after quarter turns of the axle since there are four container units. However, other turn portions can be used to correspond to the number of container units in the rack.

The indexing means 100 includes an indexing wheel 102 rotatably mounted on the axle 40 or an extension thereof. A gear 104 is rotatably mounted on a bushing 106, with the bushing being fixed to the axle 40 for rotation therewith. A spring 108 has one end thereof connected to the gear 104 and the other end thereof connected to the indexing wheel 102. The spring 108 is snugly fit to the bushing but is not connected thereto. A dog 110 is fixed at one end thereof to the ear 30 and has a head 112 on the other end thereof. The indexing wheel has a plurality, in this case four, indexing notches 114 defined therein. The indexing notches are oriented to receive the head 112. The dog element 110 includes a biasing means 116 that biases the head toward the indexing wheel. The dog element is shown in FIGS. 12 and 13 on the bottom of the indexing wheel 102, and on the top of that wheel in Figure 11 to illustrate that the dog element can be located in the most convenient location.

With the axle rotating under the influence of the container weight, the gear 104 will not move as long as indexing wheel 102 is held from rotating by dog element 110; however, when the dog is withdrawn momentarily by manually withdrawing it from a notch, the wheel 102 is dragged around by the spring which now grips the bushing 106 firmly and hence rotates with it. Since gear 104 is attached to the spring, it too will rotate at the same speed as the bushing with the axle. When the rotation of the indexing wheel 102 is stopped by the re-engagement of the dog element with a notch, the spring will open slightly, slip on the bushing, and no longer drive the gear 104. By adding suitable weights to the indexing wheel, that wheel can act like a flywheel so the clutch will take hold gradually and with a smooth action. When the dog element is disengaged, the spring will be opened slightly due to the rotation action against the stationary indexing wheel. When the wheel is released, it rotates forward a slight amount and causes the spring to grip the bushing. If enough weight is added to the wheel, as the axle begins to rotate, its motion will be resisted by inertia of the wheel, which, in turn, prevents the indexing means from engaging too quickly.

It is understood that while certain forms of the present invention have been illustrated and described herein, it is not to be limited to the specific forms or arrangements of parts described and shown.

What is claimed is:

1. A storage rack comprising:

A) a support unit including (1) an axle having two ends, (2) a support wheel on each end of said axle, each support wheel including a plurality of support holes defined therethrough to be circumferentially spaced apart from each other and to be radially equidistant from a center of said support wheel, and (3) a bracket that includes a base having two ends and mounting element receiving means defined thereon near each end, a triangular ear on each end of said base, each ear having an apex which is spaced from said base and which is rotatably connected to an end of said axle to support said axle;

B) a first container unit including (1) a rectangular container having a base and a wall, (2) two L-shaped rod elements, each support element having a long leg fixed to said container and a short leg pivotally attached to one support wheel in one of said support holes.

2. The storage rack defined in claim 1 further including a second container unit attached to said support wheels and spaced from said first container unit.

3. The storage rack defined in claim 2 further including a closing means on one of said containers.

4. The storage rack defined in claim 3 wherein said closing means includes a top plate fixed to the wall of said container.

5. The storage rack defined in claim 4 further including a hinge element on said top plate.

6. The storage rack defined in claim 5 further including a movable plate section connected to said hinge element.

7. The storage rack defined in claim 2 further including an expanding means on one of said containers.

8. The storage rack defined in claim 7 wherein said expanding means includes a chamber defined in said base and a first plate element slidably received in said chamber.

9. The storage rack defined in claim 8 wherein said expanding means further includes stop means on said first plate and on said base.

10. The storage rack defined in claim 9 wherein said expanding means further includes a chamber defined in said first plate and a second plate slidably received in the chamber defined in said first plate.

11. The storage rack defined in claim 10 wherein said expanding means further includes stop means on said second plate.

12. The storage rack defined in claim 11 wherein said expanding means further includes a wall portion on said first plate.

13. The storage rack defined in claim 2 further including an indexing means.

14. The storage rack defined in claim wherein said indexing means further includes a spring clutch mechanism.

15. The storage rack defined in claim 14 wherein said spring clutch mechanism includes an indexing wheel rotatably mounted on said axle, a bushing fixed to said axle for rotation therewith, a spring connected at one end to said bushing and at another end thereof to said indexing wheel, a plurality of notches defined in said indexing wheel, said indexing notches being spaced apart from each other around the circumference of said indexing wheel, and a dog element fixed at one end thereof to said triangular ear and having a head on another end thereof located adjacent to said indexing wheel.

16. The storage rack defined in claim 14 wherein said spring clutch mechanism further includes a biasing means in said dog element biasing said dog element head towards said indexing wheel notches.

* * * * *